US005486907A

United States Patent [19]

Watanabe et al.

[11] Patent Number: 5,486,907

[45] Date of Patent: Jan. 23, 1996

[54] BRUSH CHARGING DEVICE FOR AN IMAGE FORMING APPARATUS AND A METHOD FOR MANUFACTURING THE SAME

[75] Inventors: Takeshi Watanabe; Minoru Yoshida, both of Tokyo; Shigeru Fujiwara; Masashi Takahashi, both of Kanagawa, all of Japan

[73] Assignee: Kabushiki Kaisha Toshiba, Kawasaki, Japan

[21] Appl. No.: 208,708

[22] Filed: Mar. 11, 1994

[30] Foreign Application Priority Data

Mar. 25, 1993 [JP] Japan ..... 5-066302

[51] Int. Cl.[6] ..... G03G 15/02

[52] U.S. Cl. ..... 355/219; 361/225

[58] Field of Search ..... 355/219, 222, 355/203, 204, 208, 271, 276, 277; 361/212, 225

[56] References Cited

U.S. PATENT DOCUMENTS

| | | | |
|---|---|---|---|
| 4,005,512 | 2/1977 | Kandel | 15/160 |
| 4,032,196 | 6/1977 | Kandel | 300/21 |
| 4,106,933 | 8/1978 | Taylor | 96/1.5 R |
| 4,455,078 | 6/1984 | Mukai et al. | 355/219 |
| 4,457,615 | 6/1984 | Seanor | 355/219 |
| 4,706,320 | 11/1987 | Swift | 355/219 X |
| 4,835,807 | 6/1989 | Swift | 15/1.51 |
| 5,287,146 | 2/1994 | Uno et al. | 355/219 |
| 5,289,234 | 2/1994 | Asano et al. | 355/219 |
| 5,294,962 | 3/1994 | Sato et al. | 355/219 |

FOREIGN PATENT DOCUMENTS

| | | |
|---|---|---|
| 0521451 | 1/1993 | European Pat. Off. . |
| 57-185456 | 11/1982 | Japan . |
| 60-032073 | 2/1985 | Japan . |
| 60-216363 | 10/1985 | Japan . |
| 61-041160 | 2/1986 | Japan . |
| 63-210862 | 9/1988 | Japan . |
| 1-23780 | 5/1989 | Japan . |

OTHER PUBLICATIONS

Masatoshi Kimura, *The Society of Electrophtography of Japan*, pp. 10–19, Mar. 24, 1993.

*Primary Examiner*—Sandra L. Brase
*Attorney, Agent, or Firm*—Foley & Lardner

[57] ABSTRACT

A brush charging device for an image forming apparatus, which charges a surface of an image carrier rotating in a predetermined direction, has a linear mount member, a base cloth mounted on the mount member and a brush member having fibers mounted on the base cloth at an angle $\theta_1$. The angle $\theta_1$ satisfies the following formula: $\cos\theta_1 > c/(a+b)$ wherein a represents the radius of the image carrier, b represents the length of the brush fibers and c represents the distance between a point of intersection where a perpendicular line extending from the center of the image carrier to the base cloth intersects the base cloth and an edge portion of the base cloth located upstream going in the direction of the image carrier, and where the brush fibers contact the surface of the image carrier.

3 Claims, 5 Drawing Sheets

BRUSH CHARGING DEVICE FOR AN IMAGE FORMING APPARATUS AND A METHOD FOR MANUFACTURING THE SAME

BACKGROUND OF THE INVENTION

1. Field of the Invention

The present invention relates to a brush charging device for use in an image forming apparatus and to a method for manufacturing the brush charging device.

2. Description of the Related Art

In recent years, a contact charging device such as a charging brush has been employed in place of a corona charger. The charging brush does not produce a large amount of ozone. However, when such charging brush is used for copying machines and printers especially electronic photo-copying apparatus employing a reversed developing method, a number of lines are produced on the printing surface during the printing of half tones as if drawn by a paint brush. In an electronic photo-copying apparatus employing the reversed developing based on negative charges, such lines appear as white lines. This means that the surface potential of the photo-sensitive drum is locally higher on the negative side. These uneven lines are peculiar to the brush, especially remarkable in a fixed type conductive brush. Furthermore, a charging brush whose surface has substantially the same curvature as that of the photo-sensitive drum surface should be used so that the tip of the brush uniformly contacts the photo-sensitive drum surface as disclosed in Japanese Patent Disclosure (kokai) No. 210862/88. But no appropriate method has been known for mass-producing such brushes.

SUMMARY OF THE INVENTION

An object of the present invention is to provide a method for manufacturing a fixed type conductive brush which uniformly charges the surface potential of a photo-sensitive drum or the like.

Another object of the invention is to provide a charging device having a fixed type conductive brush which uniformly charges the surface potential of a photo-sensitive drum surface or the like.

An additional object of the invention is to provide a charging method using a fixed type conductive brush which uniformly charges the surface potential of a photo-sensitive drum surface or the like.

In order to achieve the above objects, a brush charging device for an image forming apparatus is manufactured by the method having the steps of sewing brush fibers on base cloth such that the brush fibers are positioned vertically with respect to the base cloth, mounting the base cloth with the brush fibers onto a support member which has substantially the same curvature as that of the image carrier and linearly cutting the tip of the fibers on the base cloth mounted on the support member.

A brush charging device for an image forming apparatus, which charges a surface of an image carrier moving in a predetermined direction, has a linear mount member, a base cloth mounted on the mount member and a brush member having fibers sewed on the base cloth at a predetermined angle with respect to the base cloth.

An image forming apparatus, which has an image carrier moving in a predetermined direction on which an electrostatic latent image is formed and a developing device for developing the latent image on an image receiving medium, includes a charging device fixed with respect to the image carrier for charging the surface of the image carrier having a linear mount member, a base cloth mounted on the mount member and a brush member having fibers sewed on the base cloth at a predetermined angle and a discharge device for discharging the fibers located upstream going in the moving direction of the carrier when the charging is initiated.

An image forming apparatus, which has a image carrier rotating in a predetermined direction on which an electrostatic latent image is formed and a developing device for developing the latent image on an image receiving medium, includes means fixed with respect to the image carrier for charging the surface of the image carrier, the charging means having fibers contacting to the surface of the image carrier and means for applying a predetermined bias potential superposed on a d.c. potential to the charging means the extent that saturated charing is prevented.

DETAILED DESCRIPTION OF THE PREFERRED EMBODIMENTS

Figure 1A:
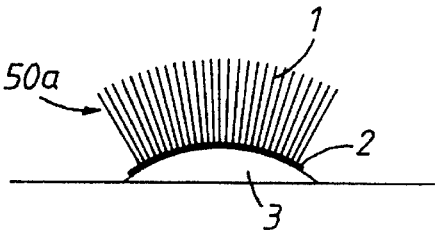
FIGS. 1 (*a*), (*b*), and (*c*) are schematic views showing one embodiment according to the present invention for manufacturing a charging brush.
Figure 1B:
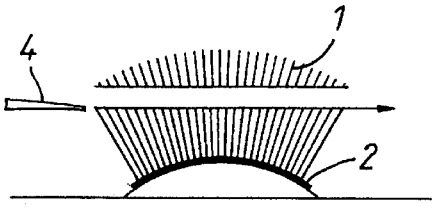
Figure 3A:
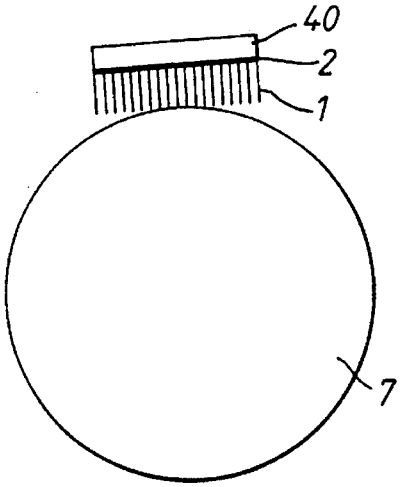
Fig.3(a) PRIOR ART
FIGS. 3 (*a*) and (*b*) are views showing a conventional charging brush and how the charging brush contacts a rotating drum.
Figure 3B:
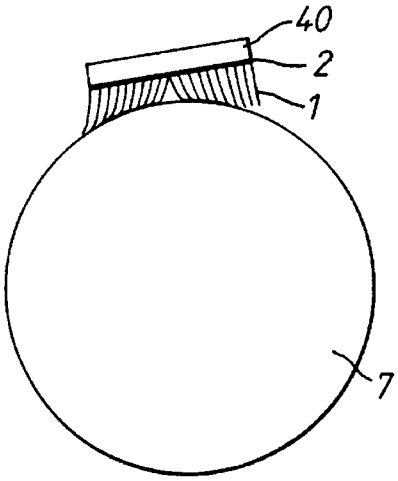
Fig.3(b) PRIOR ART

FIGS. 1 (*a*) to (*c*) show a first embodiment of the method according to the present invention for manufacturing a fixed type conductive charging brush which can uniformly charge the surface of a photo-sensitive drum. A material of the fixed type conductive brush 50*a* is rayon mixed with carbon or conductive fibers 1 formed of nylon, and these fibers 1 are sewed on a conductive base cloth 2 and bundled in a suitable density to be a brush-like form. FIG. 1 (*a*) shows the conductive fibers 1 bundled in a suitable density on the base cloth 2 and placed on a support member 3 which has substantially the same curvature as that of the photo-sensitive drum. FIG. 1 (*b*) shows a way of cutting the brush edge in such a manner that a cutter 4 is horizontally moved to cut off the edge portions of the conductive fibers 1 at predetermined length. The base cloth 2 where the conductive fibers 1 are bundled is removed from the support member 3 and the base cloth 2 is made again to be horizontal, thus obtaining the conductive charging brush 50*a* which has such curvature as is substantially equal but reverse to that of the support member 3, as shown in FIG. 3 (*c*).

As mentioned above, such a simple method enables the brush face of the fixed type conductive charging brush 50*a* to be so formed to provide substantially the same curvature as the photo-sensitive drum. Note that the curvature of the edge face of the fixed type conductive charging brush 50*a* obtained by this method, or strictly speaking, the curvature of the end face of the conductive fibers 1 supported on the support member 3 is slightly greater than that on the support surface, and therefore, it is preferable that the curvature of the support member 3 should be made to be slightly smaller than that of the photo-sensitive drum in advance.

Figure 2:
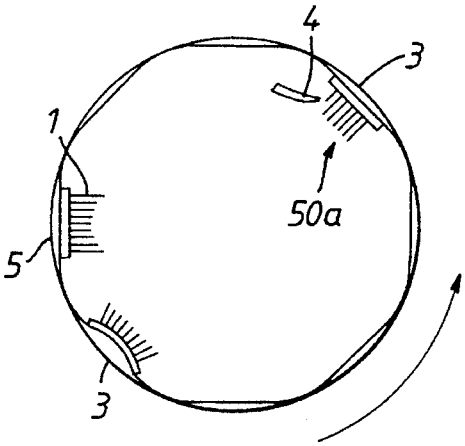
FIG. 2 is a schematic view showing another embodiment for manufacturing a charging brush.

As shown in FIG. 2, a method of cutting the brush tip of the conductive charging brush 50*a* comprises the steps of mounting the support member 3 inside the drum 5, which member 3 supports the base cloth 2 planted with the fibers 1, of rotating the drum 5, and of cutting the brush tip by the cutter 4 installed inside the drum 5. Of course, the same result may be obtained by rotating the cutter 4 without rotating the drum 5.

Next, as a second embodiment of the invention, a fixed type conductive charging brush 50*b* will be explained, in which the shape of the tip of the fixed type conductive charging brush does not coincide with the curvature of the photo-sensitive drum but the photo-sensitive drum can be charged uniformly.

It has already been pointed out that one of the significant factors causing white lines in half tone image in brush charging is how the tips of the fibers contact the photo-sensitive drum surface. Conventionally, the conductive brush 40 in which the conductive fibers 1 forming a flat end face of the brush are bundled in a suitable density on the base cloth 2 has been used in such a manner that the brush 40 contacts the surface of a photo-sensitive drum 7 as shown in FIG. 3 (*a*) and the predetermined pressure is applied to the charging brush 40 whereby the tip of the charging brush 40 is pressed into the photo-sensitive drum 7 at a certain amount as shown in FIG. 3 (*b*). Thus, the end face of the charging brush 40 is parted into two sections and, upstream going in the direction of the photo-sensitive drum 7, the fibers of the charging brush 40 are oriented wrongly against the rotation of the photo-sensitive drum 7. Several white lines are produced when half tones images are being printed by using an electronic photo-copying apparatus provided with the charging brush 40 based on the reversed developing method. A great amount of white lines are produced with the charging brush 40 contacting the photo-sensitive drum 7.

Figure 4A:
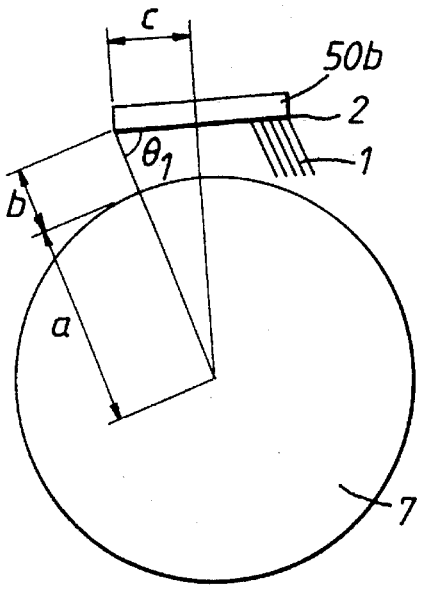
FIGS. 4 (*a*) and (*b*) are views showing a charging brush according to the invention and how the charging brush contacts the rotating drum.
Figure 4B:
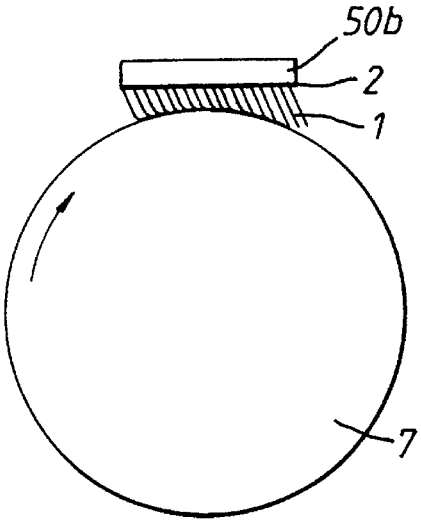

The charging brush of the second embodiment is shown in FIG. 4 (*a*), wherein the conductive fibers 1 are planted obliquely onto the base cloth 2 in a suitable density so that the brush fibers are oriented uniformly forward with respect to the rotation of the photo-sensitive drum 7 to uniformly charge the drum 7. The angle at which the brush fibers are planted obliquely is such that the brush fibers 1 contacting the surface of the photo-sensitive drum 7 most upstream going in the direction are oriented downstream going in the direction of the drum. In other words, in FIG. 4 (*a*), providing that $\theta_1$ stands for an angle defined by the brush fibers 1 contacting the surface of the photo-sensitive drum 7 and the edge portion of the base cloth 2 most upstream going in the direction of the drum, and that reference symbol a stands for the radius of the photo-sensitive drum 7, b for the length of the brush fibers 1, and c for the distance between a point of intersection where a perpendicular line extending from the center of the photo-sensitive drum 7 to the charging brush 5 intersects the brush base cloth 2 and the upstream edge portion of the base cloth, i.e., for the width of the upstream brush fibers 50*b*, the following formula is obtained:

$$\cos\theta_1 > c/(a+b)$$

As shown in FIG. 4 (*b*), the rotation of the photo-sensitive drum 7 enables the brush fibers 1 of the charging brush 50*b* to be oriented in the rotating direction (i.e. downstream) all together, without any fiber 1 being oriented reversely. Hence, the fixed type conductive brush 50*b* on which fibers are planted obliquely, compared with the brush on which fibers are not planted obliquely is effective in curbing white lines, leading to significant reduction in the number of the white lines produced during printing with the charging brush contacting the photo-sensitive drum surface, especially under low humidity environment.

Figure 5A:
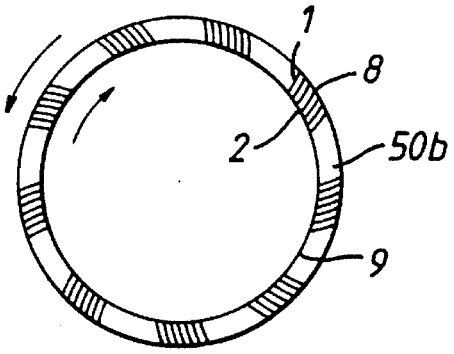
FIGS. 5 (*a*) and (*b*) are schematic views showing the process Of finishing brush fibers to be inclined.
Figure 5B:
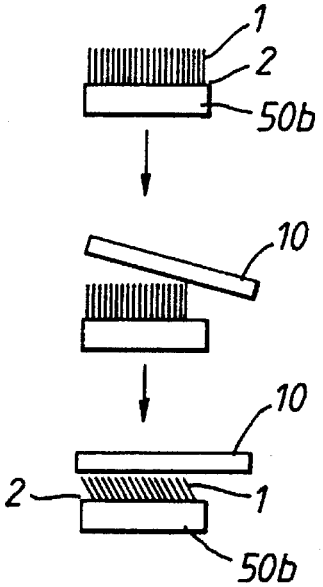

Brush fibers can be planted obliquely, as shown in FIG. 5 (*a*), by clamping the base cloth 2 planted with the conductive fibers 1 between a cylindrical receptacle 8 and a cylindrical member 9 having a smaller diameter than that of the receptacle 8 and then rotating either or both of the members. Further, as another method, the brush fibers also can be planted obliquely, as shown in FIG. 5 (*b*), by gradually pressing a plate-like member 10 while moving from one end portion of the brush 1 to the other end.

Figure 6A:
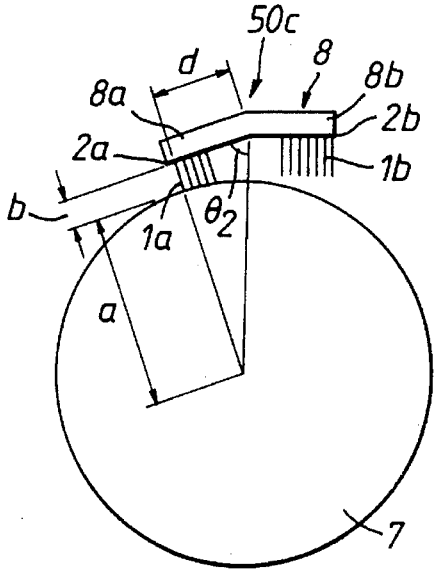
FIGS. 6 (*a*) and (*b*) are views showing a modified example of the charging brush shown in FIGS. 4 (*a*) and (*b*) and how the charging brush contacts the rotating drum.
Figure 6B:
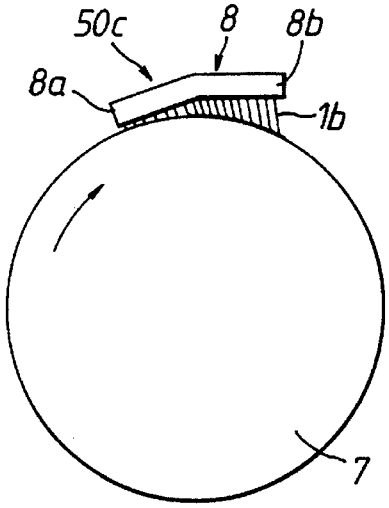

A charging brush 50*c* shown in FIG. 6 (*a*) is a modification of the charging brush which provides the same effect as the charging brush 50*b* of FIG. 5 (*a*) without the conductive fibers being inclined. A mount member 8 of the charging brush 50*c* has a first mount section 8*a* so that a portion of the rush fibers 1 located upstream going in the direction of the photo-sensitive drum 7 corresponds to the curved surface of the drum 7. In the first mount section 8*a*, brush fibers 1*a* (which are located upstream going in the direction of the photo-sensitive drum) are bundled in a suitable density on a base cloth 2a in the vertical direction thereto. In a second mount section 8*b*, brush fibers 1*b* (which are located downstream going in the direction of the photo-sensitive drum) are bundled in a suitable density on a base cloth 2*b* in the vertical direction thereto. Although the first mount section 8*a* and second mount section 8*b* are connected continuously with each other, they do not define the same plane. As shown in FIG. 6 (*a*), providing that reference symbol a stands for the radius of the photo-sensitive drum 7, b for the length of the brush fibers, $\theta_2$ for the angle defined by the first mount section 8*a* and a position of the brush fibers 1*b* on the base cloth 2*b* located most upstream (the center of the photo-sensitive drum is on a line extending from this position), and d for the length of the first mount section 8*a*, the following formula is obtained:

$$\tan\theta_2 \leqq (a+b)/d$$

Figure 7:
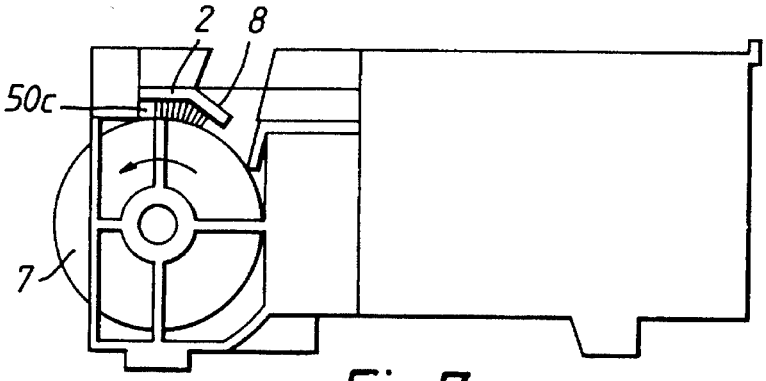
FIG. 7 is a front view of a process cartridge comprising the charging brush embodied according to the invention.

Using this charging brush 50*c* enables the brush fibers 1*a* located upstream going in the direction of the photo-sensitive drum 7 to be pressed over the drum 7 more firmly, providing stable charging in spite of the small charging width d because the density of the brush fibers is high. When the charging brush 50*c* is used in an electronic photo-copying apparatus, as shown in FIG. 7, a process cartridge can also serve as the mount member 8 by inclining a portion of the process cartridge in advance, and the charging brush 50*c* is mounted on this portion together with the base cloth 2.

The above second embodiment and its modification that is, the charging brushes 50*b* and 50*c* are so manufactured that the brush fibers 1 located upstream going in the direction of the photo-sensitive drum 7 obliquely, contact the surface of the photo-sensitive drum 7.

However, even the charging brush having such conventional form as shown in FIG. 3 (*a*) can also reduce white lines like the charging brush whose fibers are inclined, by orienting the brush fibers 1 toward the direction that the photo-sensitive drum 7 rotates before it is used.

Figure 8:
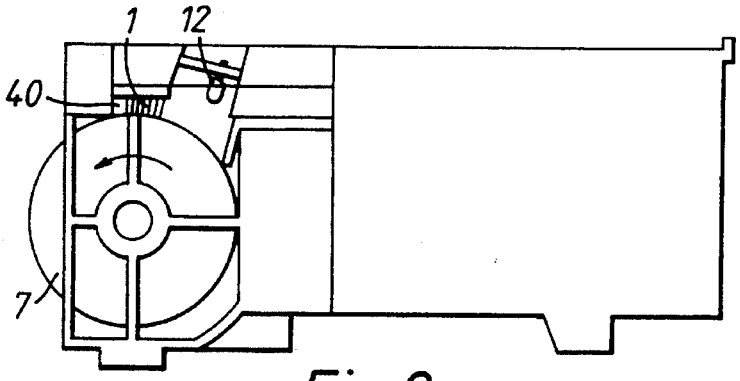
FIG. 8 is a view showing a process cartridge which has a lamp for irradiating part of the charging brush.

A third embodiment of the invention is an image forming apparatus including a fixed type charging brush having the conventional form wherein a rotating means is added which rotates a photo-sensitive drum in a few minutes before charging the drum while fibers of the charging brush are made to contact the drum surface. Preferably, the apparatus further includes means for applying a predetermined bias to the brush fibers. FIG. 8 shows a process cartridge having a charging brush 40 whose fibers are not inclined, a photo-sensitive drum 7 which contacts the brush 40, and a lamp 12 for irradiating a portion of the brush 40 upstream which first contacts the drum surface. The lamp 12 is so constructed to operate as soon as the photo-sensitive drum 7 is charged. Therefore, the lamp 12 discharges the brush 40 upstream, and serves for preventing the influence of the brush fibers 1 upstream sticking out which may cause white lines. Since the brush fibers 1 are bundled in a high density on the base cloth 2 and their color typically is black, light from the lamp 12 for de-energization does not enter the charging brush 40, with portions of the charging brush 40 charged well except for upstream ones, thereby reducing upstream charging unevenness of the brush 40. Thus, it is possible to obtain the same effect as when using the charging brush whose fibers are inclined.

For comparison with the respective embodiments and their variations described above, the following test was performed and the results from evaluating the amount of produced white lines are tabulated. A reverse developing laser printer having a resolution of 300 dpi and a printing speed of 8 pages/minute was used for the test. A negative charging organic photo-sensitive drum having a diameter of 30 mm was used, and widths of the brushes are all 9 mm and lengths of the brush fibers are 4 mm. The brush charging device uses fibers mixed with carbon. The amount by which the brush fibers are pressed into the photo-sensitive drum was set to be as small as possible in the extent that the whole surfaces of the planted brush fibers contact the drum. The resistance of the whole brush is about $10^5\ \Omega$.

This test was performed under low humidity environment and evaluation was made on the amount of white lines in a printed image when (1) printing from the beginning by using a new fixed type charging brush, (2) irradiating light upstream onto the brush as shown in FIG. 8, or applying no bias to the brush and rotating the photo-sensitive drum for 12 minutes without feeding papers (equal to about 100 pages) and then printing half tone images whose dot area factor was 50%, and (3) applying a constant bias of −0.5 to −1.3 kv to the brush and rotating the photo-sensitive drum for 12 minutes without feeding papers, and then printing half tone images. The results of the evaluation are shown in Table 1.

TABLE 1

Figure 1C:
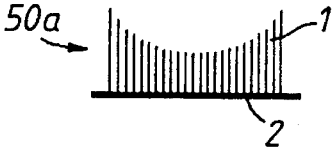

| | Test | Type of Brush | Result | White Lines |
|---|---|---|---|---|
| | 1 | Conventional | Poor | Many |
| 1 | 2 | Shown in FIG. 1(c) | Excellent | Very Few |
| | 3 | Shown in FIG. 4(a) $\theta_1 = 60°$ | Good | Few |
| | 4 | Shown in FIG. 4(a) $\theta_1 = 85°$ | Fair | Some |
| | 5 | Shown in FIG. 6(a) $\theta_2 = 60°$ | Good | Few |
| | 6 | Shown in FIG. 6(a) $\theta_2 = 85°$ | Fair | Some |
| 2 | 7 | Conventional | Good | Few |
| | | ( a lamp is used as shown in FIG. 8 ) | Good | Few |
| | 8 | Conventional (No biasing) | Good | Few |
| 3 | 9 | Conventional (−0.5KV bias) | Good | Few |
| | 10 | Conventional (−0.8KV bias) | Excellent | Very Few |
| | 11 | Conventional (−1.0KV bias) | Excellent | Very Few |
| | 12 | Conventional (−1.2KV bias) | Excellent | Very Few |

While few white lines are found when using the charging brush which is mounted on a member and has the same curvature as the photo-sensitive drum (result 2), the number of white lines is similarly reduced even when energizing the conventional type brush and rotating the photo-sensitive drum without feeding about 100 papers followed by printing (results 9 to 12). Further, without biasing the brush, similar effect can be obtained as in the case that the brush fibers are inclined (results 3 to 6) by causing the fixed type brush to contact the drum surface and rotating the drum for a few minutes in advance so that the brush fibers are oriented toward a certain direction and inclined and, then, the number of white lines is reduced (result 8). When the applied bias was not higher than 0.5 kv, the results were not significantly different from the case without applying bias, but the number of white lines was much reduced when the bias was not less than 0.8 kv (results 10 to 12). This means that, since the bias typically used is about −0.1 kv applying more than 80% of the typical bias is effective in reducing white lines.

As for the charging brush whose fibers are inclined, few white lines are observed when the angle of inclination of the fibers is within the predetermined range (results 3), and more white lines are observed when the angle of inclination is out of the range (result 4). Also, the charging brush mounted on an inclined member provides the same result as above. The number of white lines is reduced when the angle of inclination is within the range (result 5), but more white lines are observed when the angle of inclination is out of the range (result 6). However, in both cases, the number of white lines is clearly reduced compared with the case of using the charging brush incorporating no measures (result 1). By irradiating light upstream onto the charging brush, the number of white lines is reduced compared with the case incorporating no measures. (result 7).

Next, a fourth embodiment of the invention will be described. The embodiment is a method for uniformly charging a photo-sensitive drum key superposing ac bias voltage on dc voltage applied to a charging brush for use in a reversed developing laser printer. The photo-sensitive drum of the laser printer is negatively charged and therefore, when describing this embodiment, the expression will be used that the higher the voltage on the negative side, the higher or greater the potential.

Figure 9:
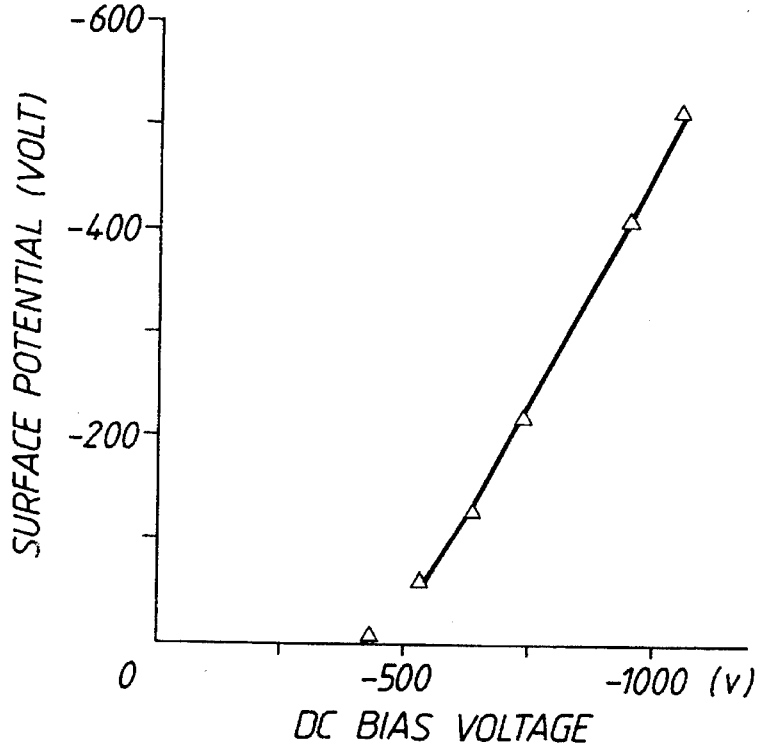
FIG. 9 is a graph showing a relationship between a dc voltage applied to the charging brush and a charging potential of the rotating drum.

As in FIG. 9, when dc bias is applied to the charging brush, the surface potential of the photo-sensitive drum contacting the brush rapidly increases when the applied voltage across the brush is around −500 v, and it substantially linearly increases above −500 v. Namely, the applied voltage across the brush of the least about −500 v is required to charge the photo-sensitive body. When the photo-sensitive body has been charged the surface potential of the photo-sensitive drum linearly increases in accordance with an increase in the applied voltage across the brush, so that the potential difference between the photo-sensitive drum and the charging brush is kept substantially constant. When a voltage of −1000 v is applied across the charging brush, the photo-sensitive drum is charged with −500 v.

Figure 10:
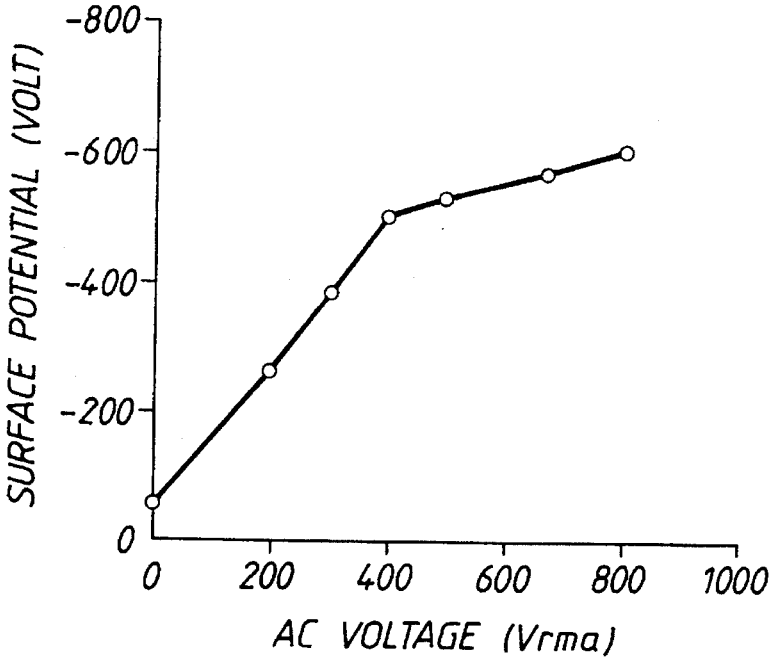
FIG. 10 is a graph showing changes in the voltage of the rotating drum charged when an ac bias voltage is superposed on adc voltage applied to the charging brush.
Figure 11A:
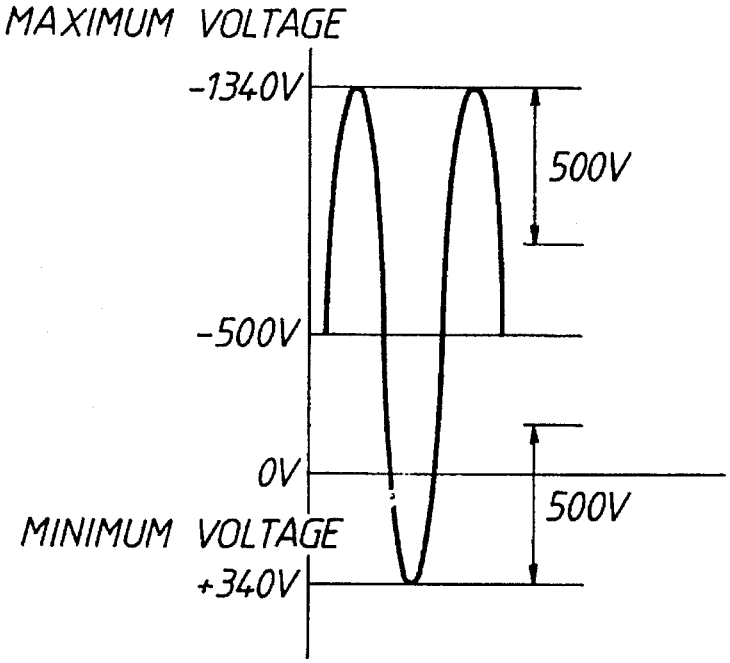
FIGS. 11 (*a*) and (*b*) are graphs showing potential change in the charging brush when an ac bias voltage is superposed on a dc voltage.
Figure 11B:
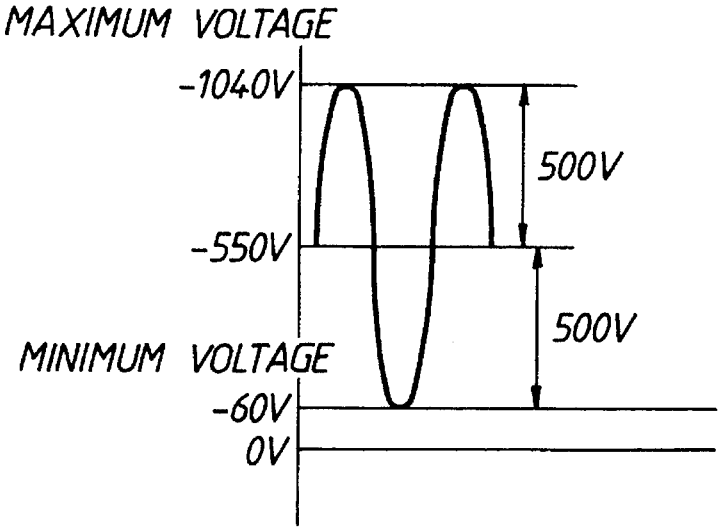

On the other hand, FIG. 10 is a graph showing a relationship between the surface potential of the photo-sensitive drum 7 and the bias voltage when ac bias voltage is superposed on the charging brush 40 across which −500 v dc voltage has been applied. Changes in the potential of the charging brush 40 are shown in FIG. 11 (*a*). The graph of FIG. 10 shows that the changes in the surface potential of the photo-sensitive drum 7 are different around the ac bias voltage of 400 v. Namely, when the ac voltage is beyond 400 v, the degree of an increase in the surface potential of the photo-sensitive drum becomes very small, i.e., the saturated voltage area is reached.

In the charging method according to the invention, ac bias voltage in the extent that the surface potential of the photo-sensitive drum does not reach the saturated voltage area is applied across the charging brush 40 supplied with the predetermined dc voltage. When the ac bias voltage is less than 400 v, the surface potential of the photo-sensitive drum 7 increases at a constant rate, dc fixed bias having the same value as the maximum of the brush bias is applied and, at the same time, the photo-sensitive drum is charged. Namely, if a dc voltage of −550 v is applied across a brush charger and an ac bias voltage of 350 v is superposed on the dc voltage, the maximum value of the brush bias is −1040 v (−550−350×1.4) and the minimum value of the brush bias is −60 v (−550+350×1.4) (see FIG. 11 (*b*)). The surface potential of the photo-sensitive drum reaches about −550 v. Since the surface potential of the photo-sensitive drum −550 v, even if the minimum value of −60 v is applied across the charging brush, a potential difference from the surface potential of the photo-sensitive drum is about 490 v }−60−(−550)≡, therefore, not charging the brush side. Namely, when the brush bias is the maximum value, the surface potential of the charged photo-sensitive drum hardly changes while the charging brush contacts the photo-sensitive drum, and it is kept at about −550 v. In other words, the potential of the portion charged at a suitable surface potential is prevented from reducing as in the case that only dc voltage is applied across the brush.

Although it has been explained that white lines are caused because the surface potential of the photo-sensitive drum is locally increased (increased on the negative side), when the brush bias is at minimum and the difference between the locally increased surface potential of the photo-sensitive drum (ex., −600 v) and the potential of the transferring brush, i.e., 540 v }−60−(−600)≡ exceeds 500 v, namely, when it exceeds the firing potential, discharging onto the positive side is started and then, the surface potential is reduced until the potential difference goes 500 v. Namely, the local potential on the photo-sensitive drum which may reduce the number of white lines, consequently, prevents white lines from being produced. Also, even if the positive side is charged without the normal discharging and the surface potential is locally reduced, the normal potential can be recovered when the maximum value of −1040 v is applied. In other words, unless such abnormal charge happens downstream on the brush, no uneven charging occurs and not only the number of white lines but also the number of black lines is not increased.

Now, when a dc voltage of −500 v, which is within the range of the saturated voltage area, is applied across the transferring brush and an ac bias voltage of 600 v is supplied on the brush, the maximum value of the brush bias is about −1340 v (−500−600×1.4) and the minimum value is about 340 v (−500+600×1.4). Since the firing potential between the brush bias and the photo-sensitive drum 7 is about 500 v, charging in the positive and negative directions happens, so that the surface potential of the photo-sensitive drum is −840 v at the maximum brush bias and −160 v at the minimum brush bias. This charging in the positive and negative directions is repeatedly performed over the whole area such that the transferring brush 40 contacts the photo-sensitive drum, and the surface potential of the photo-sensitive body 7 is finally determined by the brush bias applied to the last area that the charging brush contacts the photo-sensitive drum 7. Therefore, since most downstream where the charging brush is removed from the photo-sensitive drum, the brush fibers are not aligned in a completely linear form along the direction of the axis of the photo-sensitive drum and some of the fibers stick out, the surface potential of the photo-sensitive drum is influenced by these fibers sticking out, so that the surface potential is distributed in the range from −160 v to −840 v and it will not be uniform. As a result, even if printing half tone images, portions whose surface potentials are high become white and portions whose surface potentials are low become black. Then, no high quality image can be obtained.

Table 2 shows the results from printing half tone images under environment of high temperature and high humidity and with different bias of the charging brush by using a laser printer in order to confirm the evaluation of the invention. For a sample for evaluation, the fifth image that is printed after mounting the charging brush is used in each case.

TABLE 2

| Test | Type of Bias | Result | White Lines |
|---|---|---|---|
| 1 | DC 100V only | Poor | Many |
| 2 | DC 500V,AC800V(500Hz)(S) | Poor | Many white lines and black lines |
| 3 | DC500V,AC600V(1KHz)(S) | Poor | Many white lines and black lines |
| 4 | DC500V,AC600V(200Hz) | Poor | Same as above |
| 5 | DC550V,AC350V(1KHz)(J.S) | Good | Few |
| 6 | DC550V,AC350V(200Hz) | Excellent | Very Few |
| 7 | DC900V,AC100V(1KHz)(N.S) | Good | Few (More than 8) |
| 8 | DC900V,AC100V(200Hz) | Good | Few |

(S): Saturated voltage
(N.S): Non saturated voltage
(J.S): Just before saturated voltage When the frequency of the ac bias was 100 Hz to 1000 Hz, good results were obtained. If the frequency of the ac bias is reduced to 200 Hz, portions whose potential is increased by influence of defective fibers or excessive fibers existing a little on the brush become dot-like not line-like, and the areas between dots have the normal surface potential, thus reducing the area of white lines where the potentials are high. Since the portions appear dot-like, such non-uniformity as lines is hardly invisible to the eyes, so that the lines themselves do not stand out. It does not mean that the effect is impaired if the frequency is higher than 1000 Hz, rather the number of white lines is considerably reduced compared with the case that only dc bias is applied.

Hence, by superposing suitable ac bias on dc bias, it is possible to eliminate portions of the photo-sensitive drum surface where the potential is locally high. Namely, in addition to white lines which would occur under low humidity environment, it is possible to sharply reduce continuous white lines produced under high humidity environment.

What is claim is:

1. A brush charging device for an image forming apparatus wherein the brush charging device charges a surface of an image carrier rotating in a predetermined direction comprising:

a linear mount member;

a base cloth mounted on the mount member; and a brush member having fibers mounted on the base cloth at an angle $\theta_1$, the angle $\theta_1$ satisfying the following formula:

$$\cos\theta_1 > c/(a+b)$$

wherein a represents the radius of the image carrier, b represents the length of the brush fibers and c represents the distance between a point of intersection where a perpendicular line extending from the center of the image carrier to the base cloth intersects the base cloth and an edge portion of the base cloth located upstream going in the direction of the image carrier and where the brush fibers contact the surface of the image carrier.

2. A brush charging device for an image forming apparatus wherein the brush charging device charges a surface of an image carrier rotating in a predetermined direction comprising:

a linear mount member having first and second linear portions connected at a predetermined angle; first and second base cloths mounted on the first and second linear portions, respectively; and a brush member having fibers sewed on the first and second base cloths, respectively, wherein the brush member satisfies the following formula:

$$\tan\theta_2 \leqq (a+b)/d$$

wherein a represents the radius of the image carrier, b represents the length of the brush fibers and d represents the distance between an edge portion of the base cloth located in the most upstream going in the direction of the image carrier and a connecting point between the first and second linear portion, $\theta_2$ represents an angle defined by a line extending from the connecting point to the center of the image carrier and the first linear portion.

3. A brush charging device for an image apparatus wherein the brush charging device charges a surface of an electrostatic image carrier moving in a predetermined direction, comprising:

a linear mount member;

a base cloth mounted on the linear mount member;

a brush member having fibers sewed on the base cloth at a predetermined angle with respect to the base cloth; and a discharge device for discharging the fibers located upstream going in the moving direction of the carrier when the charging is initiated.

* * * * *